US007923127B2

(12) United States Patent
Das

(10) Patent No.: US 7,923,127 B2
(45) Date of Patent: Apr. 12, 2011

(54) DIRECT ROLLING OF CAST GAMMA TITANIUM ALUMINIDE ALLOYS

(75) Inventor: Gopal Das, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 1416 days.

(21) Appl. No.: 11/270,103

(22) Filed: Nov. 9, 2005

(65) Prior Publication Data

US 2007/0107202 A1 May 17, 2007

(51) Int. Cl.
*B21B 1/38* (2006.01)
*B32B 15/00* (2006.01)
*B32B 15/01* (2006.01)

(52) U.S. Cl. ..... 428/660; 428/661; 29/527.7

(58) Field of Classification Search ..... None
See application file for complete search history.

(56) References Cited

U.S. PATENT DOCUMENTS

| | | | | |
|---|---|---|---|---|
| 5,028,491 A | | 7/1991 | Huang et al. | |
| 5,284,620 A | * | 2/1994 | Larsen, Jr. | 420/590 |
| 5,411,700 A | | 5/1995 | Martin | |
| 5,424,027 A | * | 6/1995 | Eylon | 419/49 |
| 6,161,285 A | | 12/2000 | Eberhardt et al. | |
| 6,420,051 B1 | * | 7/2002 | Appel et al. | 428/577 |
| 6,669,791 B2 | | 12/2003 | Tetsui et al. | |

FOREIGN PATENT DOCUMENTS

| | | | |
|---|---|---|---|
| JP | 1072652 | A | 3/1989 |
| JP | 2224803 | A | 9/1990 |
| JP | 3-104833 | | 5/1991 |
| JP | 03 115549 | A | 5/1991 |
| JP | 5186842 | A | 7/1993 |
| JP | 5209243 | A | 8/1993 |
| JP | 7251202 | A | 10/1995 |
| JP | 8-225906 | | 3/1996 |
| JP | 08 225906 | A | 9/1996 |
| JP | 8238503 | A | 9/1996 |
| JP | 2001316743 | A | 11/2001 |

OTHER PUBLICATIONS

European Search Report, Mar. 16, 2007.
Korea Office Action Dated Oct. 25, 2007, for Korean Patent Application No. 10-2006-0109734.

* cited by examiner

*Primary Examiner* — Jennifer C McNeil
*Assistant Examiner* — Jason L Savage
(74) *Attorney, Agent, or Firm* — Bachman & LaPointe, P.C.

(57) ABSTRACT

A process for producing sheets of γ-TiAl includes the steps of forming a melt of a γ-TiAl alloy; casting the γ-TiAl alloy to form an as-cast γ-TiAl alloy; encapsulating the as-cast γ-TiAl alloy to form an as-cast γ-TiAl alloy preform; and rolling the as-cast γ-TiAl alloy preform to form a sheet comprising γ-TiAl.

6 Claims, 6 Drawing Sheets

DIRECT ROLLING OF CAST GAMMA TITANIUM ALUMINIDE ALLOYS

GOVERNMENT CONTRACT

The Government of the United States of America may have rights in the present invention pursuant to Contract No. NAS326385 awarded by the National Aeronautics and Space Administration.

FIELD OF USE

This disclosure relates to processes for manufacturing gamma TiAl alloys (hereinafter "γ-TiAl") and, more particularly, to direct rolling of γ-TiAl alloys to form sheets.

BACKGROUND OF THE INVENTION

Powder metallurgy and ingot metallurgy are two commonly used processes to produce γ-TiAl sheets as illustrated in the flowcharts of FIGS. 1*a* and 1*b* respectively.

For the powder metallurgy process shown in FIG. 1*a*, expensive argon gas atomized powders are used as the starting material. The powders are canned in a titanium can, evacuated at elevated temperatures, sealed, and then hot isostatically pressed to a billet at 1,300° C. (2372° F.) for 2 hours in order to obtain complete densification. The billet is decanned and given a surface conditioning treatment. The cleaned billet is then encapsulated and isothermally rolled in the (α+γ) phase field to yield the desired thickness. The sheets are usually bent following rolling and are flattened at 1,000° C. (1832° F.) for 2 hours in vacuum. The canned material is then removed and the flat sheet is ground from both surfaces in order to achieve the desired thickness. The yield is high but the powder metallurgy produced sheet suffers from developing thermally induced porosity due to argon gas, which is entrapped in powder particles, and this limits its superplastic forming capability.

For ingot metallurgy process shown in FIG. 1*b*, the starting material is an as-cast γ-TiAl ingot. These ingots are subjected to hot isostatically pressing to close the shrinkage porosity commonly associated with cast ingots as well as to homogenize. These ingots are then cut into desired sizes and isothermally forged at 1,200° C. (2192° F.) to pancakes. Forging can be achieved either by single or multiple operations depending on the size of the ingots. Rectangular sizes are sliced from the pancakes by an electrical discharge machining technique and the machined surfaces are ground to remove the recast layer as well as to remove the forged surfaces prior to canning for isothermal rolling as described above. The yield is low for the ingot metallurgy process where a significant part of the pancake cannot be utilized. However, the ingot metallurgy produced sheets are amenable to superplastic forming, as they do not suffer from thermally induced porosity.

Consequently, there exists a need for a process for forming sheets of γ-TiAl alloys.

SUMMARY OF THE INVENTION

In accordance with the present invention, a process for producing sheets of γ-TiAl is disclosed. This process broadly comprises forming a melt of a γ-TiAl alloy; casting the γ-TiAl alloy to form an as-cast γ-TiAl alloy; encapsulating the as-cast γ-TiAl alloy to form an as-cast γ-TiAl alloy preform; and rolling the as-cast γ-TiAl alloy preform to form a sheet comprising γ-TiAl.

In accordance with the present invention, an article made from a sheet produced in accordance with the process of the present invention is also disclosed.

In accordance with the present invention, a preform broadly comprising an as-cast γ-TiAl alloy material disposed in a canning material, wherein the as-cast γ-TiAl alloy material comprises a shape suitable for being rolled into a sheet, is also disclosed.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The process of the present invention produces articles comprising γ-TiAl by directly rolling encapsulated as-cast γ-TiAl alloy preforms into the articles. Unlike prior art processes for manufacturing γ-TiAl articles, an as-cast γ-TiAl alloy preform of the present invention does not undergo additional process steps such as atomizing, hot isostatically pressing, extruding or conditioning, prior to being encapsulated. Once the γ-TiAl alloy is cast as a preform, the as-cast γ-TiAl alloy preform is encapsulated and directly rolled to form articles comprising γ-TiAl.

For purposes of explanation, the following definitions are provided. "As-cast γ-TiAl alloy" means the γ-TiAl alloy cast material without having undergone any subsequent process steps such as, for example, atomizing, hot isostatically pressing, conditioning, extruding and the like. "As-cast γ-TiAl alloy preform" means the as-cast γ-TiAl alloy having a shape suitable for being rolled in a conventional rolling process and encapsulated with a canning material and, optionally, a thermal barrier material disposed therebetween. As used herein, the term "thermal barrier material" means a barrier material that acts as a thermal barrier and insulates the as-cast γ-TiAl alloy preform.

Figure 1A:
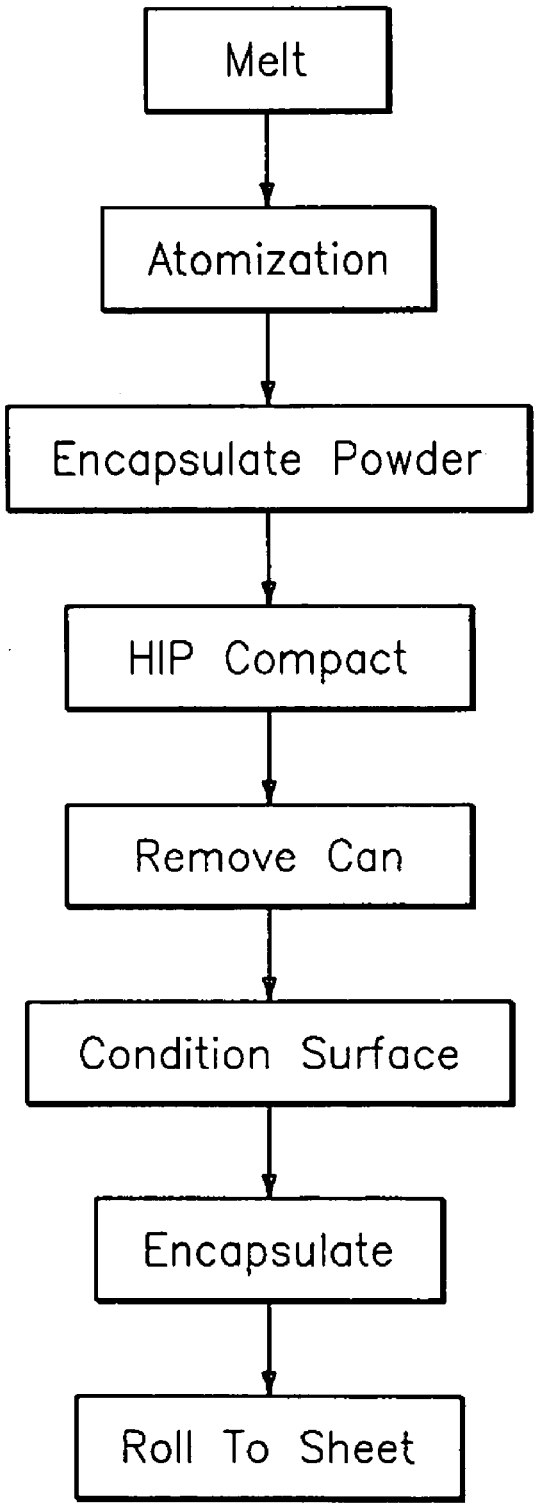
FIG. 1a (PRIOR ART)
FIG. 1*a* is a flowchart representing a powder metallurgy process of the prior art for fabricating γ-TiAl sheets.
Figure 1B:
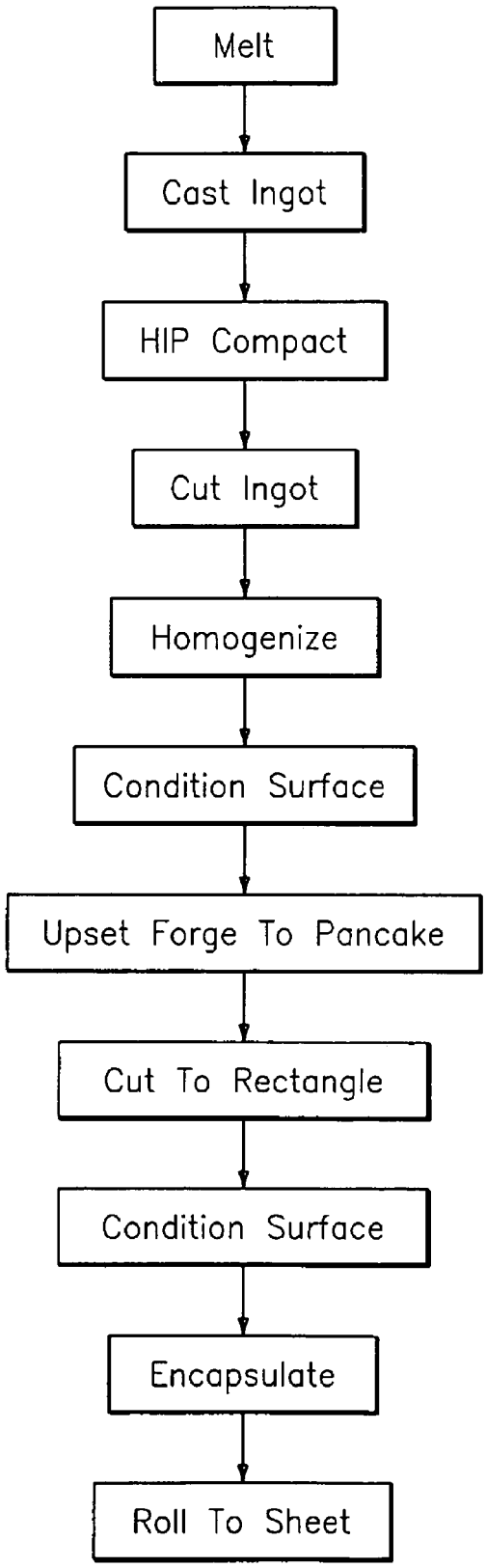
FIG. 1b (PRIOR ART)
FIG. 1*b* is a flowchart representing an ingot metallurgy process of the prior art for fabricating γ-TiAl sheets.
Figure 2:
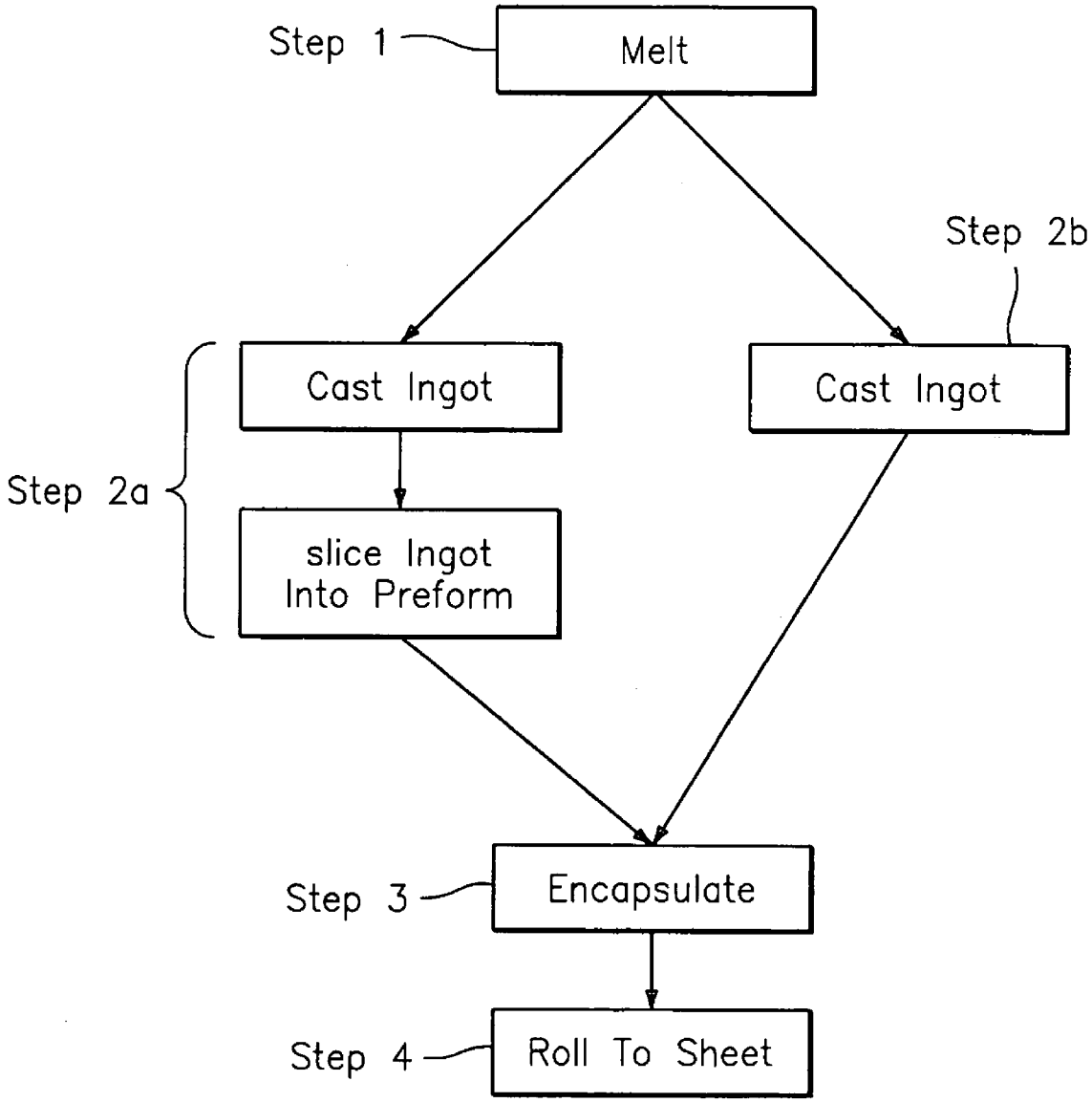
FIG. 2 is a flowchart representing a direct rolling process of the present invention for fabricating γ-TiAl sheets.

Referring now to FIG. 2, a flowchart of the process of the present invention is shown. A melt of a γ-TiAl alloy may first be formed at a step 1. The melt of the γ-TiAl alloy may be formed by one of any number of melting techniques known in the art. For example, the melt may be formed in a suitable container, such as a water cooled copper crucible, using a melting technique such as, but not limited to, vacuum arc melting (VAR), vacuum induction melting (VIM), induction skull melting (ISM), electron beam melting (EB), and plasma arc melting (PAM). In the vacuum arc melting technique, an electrode is fabricated of the alloy composition and is melted by direct electrical arc heating, i.e., an arc established between the electrode and the crucible, into an underlying non-reactive crucible. An actively cooled copper crucible is useful in this regard. Vacuum induction melting involves heating and melting a charge of the alloy in a non-reactive, refractory crucible by induction heating the charge using a surrounding electrically energized induction coil. Induction skull melting involves inductively heating and melting a charge of the alloy in a water-cooled, segmented, non-contaminating copper crucible surrounded by a suitable induction coil. Both electron beam melting and plasma melting involve melting using a configuration of electron beam(s) or a plasma plume directed on a charge in an actively cooled copper crucible.

Various γ-TiAl alloys, for example, binary γ-TiAl and other γ-TiAl alloys, may be employed using the process of the present invention. Suitable γ-TiAl alloys contain Ti and Al and may also contain Cr, Nb, Ta, W, Mn, B, C and Si in amounts sufficient to impart characteristics to the γ-TiAl alloy sheets such as improved ductility, creep resistance, oxidation resistance, impact resistance and the like. The various γ-TiAl alloys may generally comprise the following materials in atomic weight percent:

| Element | Atomic percent |
|---|---|
| Ti | about 46–54% |
| Al | about 44-47 |
| Nb | about 2-6% |
| Cr | about 1-3% |
| Mn | about 1-3% |
| Cr | about 1-3% |
| W | about 0.5-1% |
| B | about 0.2-0.5% |
| Si | about 0.1-0.4% |
| C | about 0.2% |

Referring now to steps 2*a* and 2*b* of FIG. 2, the γ-TiAl alloy melt of step 1 may be cast into a γ-TiAl alloy preform using any one of a number of casting processes known to one of ordinary skill in the art. In one embodiment illustrated at step 2*a* of FIG. 2, the γ-TiAl alloy melt may be cast as an ingot and then formed by any number of processes known to one skilled in the art, such as slicing, into an as-cast γ-TiAl alloy preform suitable for further processing in a direct rolling process known to one of ordinary skill in the art. Preferably, the as-cast γ-TiAl alloy preform has a substantially rectangular shape from which the desired article of γ-TiAl alloy, for example, a sheet, may be rolled more efficiently and effectively. In an alternative embodiment illustrated at step 2*b* of FIG. 2, the γ-TiAl alloy melt may be directly cast into an as-cast γ-TiAl alloy preform suitable for further processing in a direct rolling process known to one of ordinary skill in the art.

Referring now to step 3 of FIG. 2, the as-cast γ-TiAl alloy preform may then be encapsulated or encased rather than undergoing additional process steps as performed by prior art γ-TiAl manufacturing processes. Encapsulating the as-cast γ-TiAl alloy preform decreases the potential for oxidizing the as cast γ-TiAl alloy preform under high direct rolling temperatures. If oxidized, the as-cast γ-TiAl alloy preform may experience undesirable changes to its microstructure and properties. A thermal barrier material may be disposed upon and substantially cover the entire surface of the as-cast γ-TiAl alloy preform prior to being encapsulated. The thermal barrier prevents the formation of a eutectic with low melting point between the as-cast γ-TiAl alloy preform and the encapsulation material. The thermal barrier may be applied using any one of a number of techniques known to those of ordinary skill in the art such as by plasma spraying the thermal barrier material onto the surface of the as-cast γ-TiAl alloy preform or disposing a sheet of thermal barrier material about the entire surface of the as-cast γ-TiAl alloy preform. Suitable thermal barrier materials include, but are not limited to, molybdenum, yttria, titanium, steel, combinations comprising at least one of the foregoing, and the like. Once the thermal barrier material is applied, the as-cast γ-TiAl alloy may be disposed in a canning material using any one of a number of processes known to one of ordinary skill in the art. The canning material preferably substantially covers the entire surface of the as-cast γ-TiAl alloy having the thermal barrier material disposed thereupon. Suitable canning materials include, but are not limited to, steel and its alloys, titanium and its alloys, combinations comprising at least one of the foregoing, and the like. These canning materials possess strength and high temperature resistance comparable to γ-TiAl alloys. The encapsulation of the as-cast γ-TiAl alloy is preferably performed at a temperature range of between about 1200° C. (2192° F.) and 1250° C. (2282° F.). These temperature conditions mimic the direct rolling process conditions and ensure isothermal temperature conditions are met. It is particularly advantageous to maintain isothermal temperature conditions so that the as-cast γ-TiAl alloy preform does not undergo undesirable microstructural changes.

Referring now to a step 4 of FIG. 2, the encapsulated as-cast γ-TiAl alloy preform may then be rolled into the desired article, for example, a sheet. Conventional rolling techniques as known to one of ordinary skill in the art may be utilized. For example, rolling may be performed on a conventional rolling mill at a temperature range of between about 1200° C. (2192° F.) and 1400° C. (2552° F.), and preferably between about 1200° C. (2192° F.) and 1250° C. (2282° F.). After the encapsulated as-cast γ-TiAl articles have been rolled, the encapsulation material and thermal barrier material may then be removed by any one of a number of mechanical or chemical processing techniques known to one of ordinary skill in the art. Following the removal of the encapsulation and thermal barrier materials, the resultant γ-TiAl sheets may be surface ground using technique(s) known to one of ordinary skill in the art to achieve a desired thickness of about 25 mils (0.625 millimeters) to 100 mils (2.54 millimeters). In accordance with the processes of the present invention, the resultant γ-TiAl sheets may have a thickness of about 25 mils (0.625 millimeters) to 60 mils (1.5 millimeters) while still exhibiting a microstructure comparable to γ-TiAl sheets made using conventional γ-TiAl article processes.

Experimental Section

Sample 1

Figure 3:
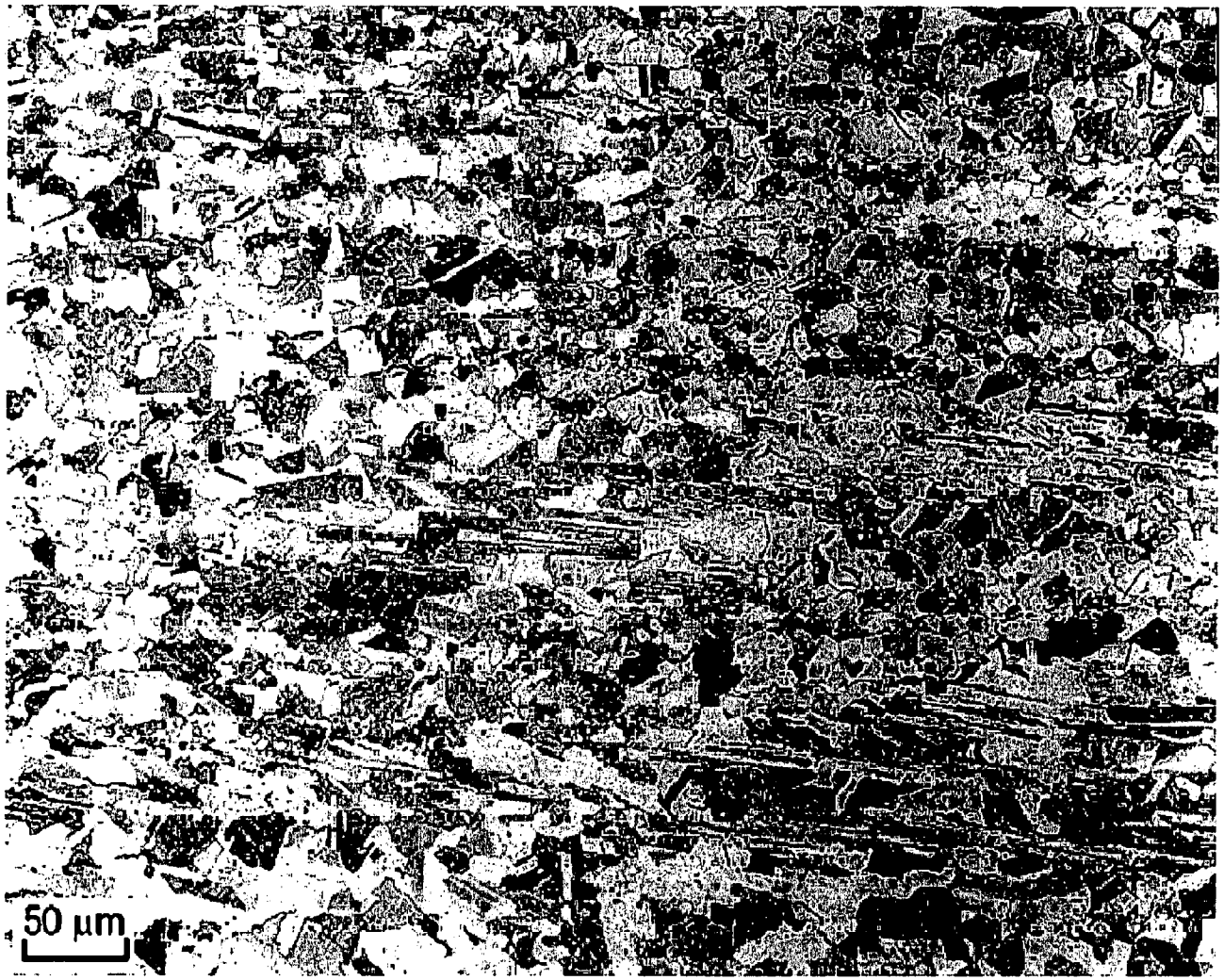
FIG. 3 is a microphotograph depicting a microstructure of a γ-TiAl sheet fabricated using the process of the present invention.

A γ-TiAl ingot having the composition 54-Ti 46-Al (in at. %) was prepared by double melted VAR casting process, each ingot having a diameter of 180 mm and a length of 410 mm. The cast γ-TiAl ingot was cut into cast γ-TiAl plates of 7 in.×12 in.×½ in. using an electro-discharge machining process. Each cast γ-TiAl plate was polished with sand paper to remove the decast layer. Each cast γ-TiAl plate was encapsulated with a titanium thermal barrier. Each encapsulated cast γ-TiAl plate was preheated for one hour at 538° C. (1000° F.) and at a pressure of $1\times10^{-5}$ torr. Each encapsulated cast γ-TiAl plate was hot rolled under a non-oxidizing atmosphere at a temperature of 1260° C. (2300° F.). Each encapsulated cast γ-TiAl plates were again preheated and hot rolled until achieving cast γ-TiAl sheets having a thickness of 100 mils. The encapsulation material was removed and the cast γ-TiAl sheets were ground to a thickness of 40 mils. The final cast γ-TiAl sheets size was 24 in.×12 in.×40 mils. The microphotograph of FIG. 3 depicts the microstructure of a cast γ-TiAl sheet of Sample 1 at a resolution of 50 microns. As shown, the cast γ-TiAl sheets of Sample 1 contain elongated, fine gamma grains and a small volume fraction of alpha-2-$Ti_3Al$. In addition, elongated platelets, the remnants of as-cast lamellar structure that did not recrystallize during rolling, are also seen.

elongated, fine gamma grains and a small fraction of elongated alpha-2-($Ti_3Al$) and $TiB_2$ particles.

Figure 4:
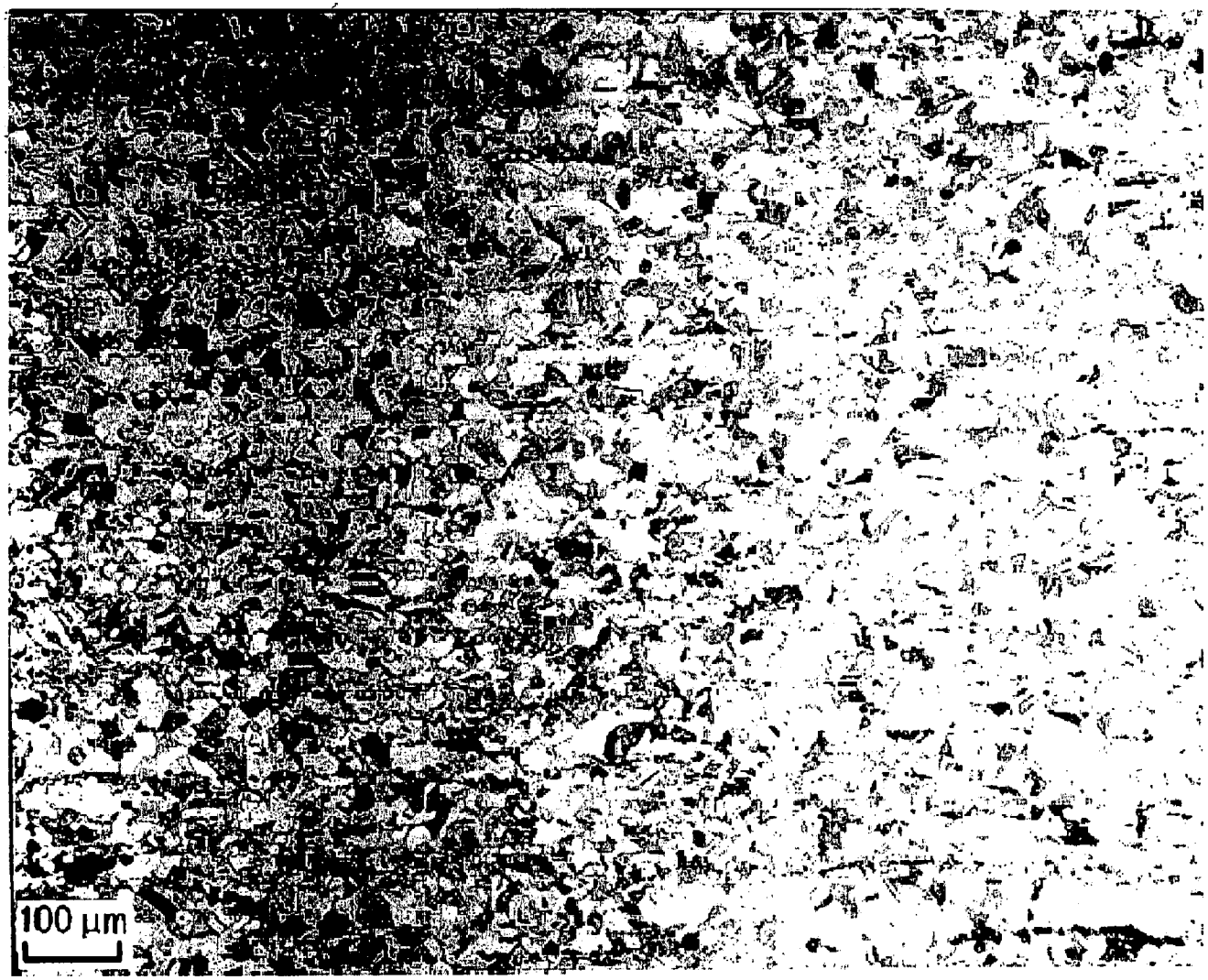
FIG. 4 is a microphotograph depicting a microstructure of another γ-TiAl sheet fabricated using the process of the present invention.
Figure 5:
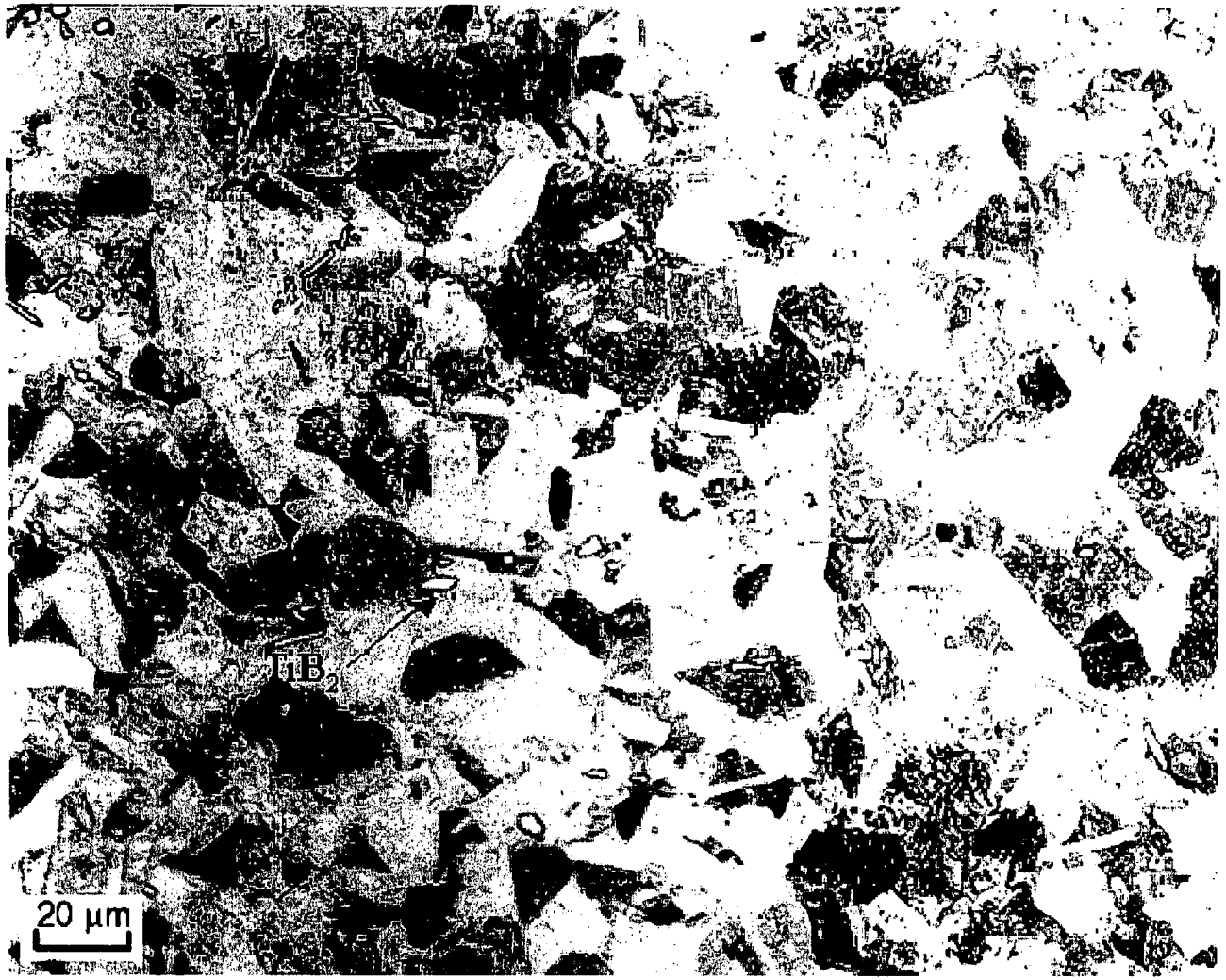
FIG. 5 is a microphotograph depicting a microstructure of another γ-TiAl sheet fabricated using the process of the present invention.

As may be seen in the microstructures of Samples 1-3 in the microphotographs of FIGS. 3-5, no porosity was found in the directionally rolled cast γ-TiAl sheets made according to the process of the present invention. Referring now to Table 1 shown below, the cast γ-TiAl sheets of Sample 3 of the present invention exhibited some enhanced mechanical properties when compared to heat-treated as-cast γ-TiAl sheets produced using commercially available as-cast, hot isostatically pressed, heat treated 47 XD γ-TiAl from Alcoa Howmet Castings of Cleveland, Ohio.

TABLE 1

| | Yield Strength (ksi) | | Ultimate Tensile Strength (ksi) | | Strain-to-failure, % | |
|---|---|---|---|---|---|---|
| Identification | RT(70° F.) | 1300° F. | RT(70° F.) | 1300° F. | RT(70° F.) | 1300° F. |
| Sample 3 47 XD Unidirectionally rolled (27 mils) | 73 | 51 | 80 | 85 | 1.0 | 22 |
| 47 XD as-cast, HIP'd + heat treated | 58 | 53 | 70 | 79 | 1.0 | 5 |

Sample 2

A γ-TiAl ingot having the composition 48.5-Ti 46.5-Al 4-(Cr, Nb, Ta, B) (in at. %) was prepared by an induction skull melting casting process, each ingot having a diameter of 180 mm and a length of 410 mm. The cast γ-TiAl ingot was cut into cast γ-TiAl plates of 7 in.×12 in.×½ in. using an electro-discharge machining process. Each cast γ-TiAl plate was polished with sand paper to remove the decast layer. Each cast γ-TiAl plate was encapsulated with a titanium thermal barrier. Each encapsulated cast γ-TiAl plate was preheated for one hour at 538° C. (1000° F.) and at a pressure of $1\times10^{-5}$ torr. Each encapsulated cast γ-TiAl plate was hot rolled under a non-oxidizing atmosphere at a temperature of 1260° C. (2300° F.). Each encapsulated cast γ-TiAl plates were again preheated and hot rolled until achieving cast γ-TiAl sheets having a thickness of 100 mils. The encapsulation material was removed and the cast γ-TiAl sheets were ground to a thickness of 40 mils. The final cast γ-TiAl sheet size was 24 in.×12 in.×40 mils. The microphotograph of FIG. 4 depicts the microstructure of a cast γ-TiAl sheet of Sample 2 at a resolution of 100 microns. The cast γ-TiAl sheets of Sample 2 contain elongated, fine gamma grains and a small volume fraction of elongated alpha-2-($Ti_3Al$) and $TiB_2$ particles.

Sample 3

A commercially available 47 XD γ-TiAl cast plate having the composition 49-Ti 47-Al 2-Nb 2-Mn (in at. %) and 0.08% by volume of $TiB_2$, and dimensions 4.8 in.×3.4 in.×0.6 in. Each cast γ-TiAl plate was encapsulated with a titanium thermal barrier. Each encapsulated cast γ-TiAl plate was preheated for one hour at 538° C. (1000° F.) and at a pressure of $1\times10^{-5}$ torr. Each encapsulated cast γ-TiAl plate was hot rolled in a non-oxidizing atmosphere at a temperature of 1260° C. (2300° F.). Each encapsulated cast γ-TiAl plate was heated and hot rolled until achieving cast γ-TiAl sheets having a thickness of 100 mils. The encapsulation material was removed and the cast γ-TiAl sheets were ground to a thickness of 27 mils. The final cast γ-TiAl sheet size was 27 in.×6.3 in.×27 mils. The microphotograph of FIG. 5 depicts the microstructure of a cast γ-TiAl sheet of Sample 3 at a resolution of 20 microns. The cast γ-TiAl sheets of Sample 3 contain γ-TiAl alloys have high ductility at temperatures above the ductile-to-brittle temperature of 1300° F. (704° C.)-1400° F. (760° C.). γ-TiAl alloys also exhibit low strength at elevated temperatures and readily recrystallize under such conditions. Given these inherent characteristics of γ-TiAl alloys, as-cast γ-TiAl alloys preforms can be successfully rolled directly into thin sheets once encapsulated under isothermal temperature conditions. Encapsulating as-cast γ-TiAl alloy preforms without first subjecting the as-cast γ-TiAl alloy to additional process steps such as atomizing, hot isostatically pressing, extruding or conditioning eliminates costly and wasteful intermediate steps employed in prior art processes. It is estimated that the process of the present invention can effectively reduce process costs by upwards of 35% over the conventional powder metallurgy and ingot metallurgy processes.

γ-TiAl articles made by the direct rolling process of the present invention also exhibit enhanced physical properties over γ-TiAl articles made by the prior art processes. Conventional powder metallurgy processes include steps performed under atmospheres such as argon. It is recognized that atmospheric particles, for example, argon gas, become trapped within the γ-TiAl alloy. Once the argon particles diffuse, the resultant γ-TiAl alloy articles exhibit thermally induced porosity and poor ductility, lower temperature resistance and reduced impact resistance. The direct rolling process of the present invention avoids this danger by eliminating the additional process steps that lead to thermally induced porosity.

It is to be understood that the invention is not limited to the illustrations described and shown herein, which are deemed to be merely illustrative of the best modes of carrying out the invention, and which are susceptible to modification of form, size, arrangement of parts, and details of operation. The invention rather is intended to encompass all such modifications, which are within its spirit and scope as defined by the claims.

What is claimed is:

1. A preform, comprising:

an as-cast γ-TiAl alloy material disposed in a canning material, wherein said as-cast γ-TiAl alloy material has a shape suitable for being rolled into a sheet and has a composition consisting of from 44-47 at % aluminum, from 2.0 to 6.0 at % niobium, from 1.0 to 3.0 at % chromium, from 1.0 to 3.0 at % manganese, from 0.5 to 1.0 at % tungsten, from 0.2 to 0.5 at % boron, from 0.1 to 0.4 at % silicon, about 0.2 at % carbon, and the balance titanium, wherein said canning material is selected from the group consisting of titanium and titanium alloys.

2. The preform of claim 1, further comprising a thermal barrier material between said as-cast γ-TiAl alloy material and said canning material.

3. The preform of claim 2, wherein said thermal barrier material is a metal alloy.

4. The preform of claim 2, wherein said thermal barrier material is a coating or a foil.

5. The preform of claim 2, wherein said thermal barrier material is selected from the group consisting of yttria, titanium, steel and combinations thereof.

6. The preform of claim 1, wherein said shape is substantially rectangular.

* * * * *